US012110636B2

(12) United States Patent
Möhring et al.

(10) Patent No.: US 12,110,636 B2
(45) Date of Patent: Oct. 8, 2024

(54) FILTER PAPER

(71) Applicant: DELFORTGROUP AG, Traun (AT)

(72) Inventors: Dieter Möhring, Wattens (AT); Guido Reiter, Terfens (AT)

(73) Assignee: DELFORTGROUP AG, Traun (AT)

( * ) Notice: Subject to any disclaimer, the term of this patent is extended or adjusted under 35 U.S.C. 154(b) by 1007 days.

(21) Appl. No.: 17/043,486

(22) PCT Filed: Mar. 4, 2019

(86) PCT No.: PCT/EP2019/055290
§ 371 (c)(1),
(2) Date: Sep. 29, 2020

(87) PCT Pub. No.: WO2019/192787
PCT Pub. Date: Oct. 10, 2019

(65) Prior Publication Data

US 2021/0123189 A1 Apr. 29, 2021

(30) Foreign Application Priority Data

Apr. 4, 2018 (DE) ..... 10 2018 107 944.3

(51) Int. Cl.
*D21H 27/08* (2006.01)
*D21H 13/24* (2006.01)
*D21H 13/26* (2006.01)
*D21H 17/67* (2006.01)

(52) U.S. Cl.
CPC ..... *D21H 27/08* (2013.01); *D21H 17/675* (2013.01); *D21H 13/24* (2013.01); *D21H 13/26* (2013.01)

(58) Field of Classification Search
CPC ..... D21H 27/08; D21H 17/675; D21H 13/24; D21H 13/26; D21H 13/14; D21H 15/10; D21H 17/67
USPC ..... 210/502.1
See application file for complete search history.

(56) References Cited

U.S. PATENT DOCUMENTS 4,984,589 A 1/1991 Riedesser
6,139,883 A * 10/2000 Gbur ..... B32B 5/26 426/77
6,568,402 B1 * 5/2003 Kaneki ..... A24D 3/043 131/365
2002/0101000 A1 8/2002 Dolfel et al.
2002/0160683 A1 10/2002 Dannhauser et al.
2004/0129632 A1 7/2004 Le Brech et al.
2005/0061733 A1 3/2005 Bentz et al.
2006/0188609 A1 * 8/2006 Jordan ..... D21H 27/08 426/77
2007/0131361 A1 * 6/2007 Doelle ..... D21H 17/675 162/181.2
2007/0232179 A1 * 10/2007 Polat ..... D21H 13/24 604/372
2012/0251597 A1 * 10/2012 Gupta ..... D04H 1/56 5/413 R
2015/0111997 A1 * 4/2015 Mesic ..... C08L 1/02 524/35
2015/0152599 A1 * 6/2015 Afflerbach ..... D21F 11/006 162/358.1
2015/0173414 A1 6/2015 Bachmann et al.
2018/0369737 A1 12/2018 Shimada et al.
2019/0059443 A1 2/2019 Bachmann et al.

FOREIGN PATENT DOCUMENTS

CA 2 481 395 A1 3/2005
DE 299 05 907 U1 7/1999
DE 103 42 416 A1 8/2003
DE 20306078 U1 11/2003
DE 10 2016 105 235 9/2017
EP 0375844 A2 7/1990
EP 1215134 A1 6/2002
EP 1229166 A1 8/2002
EP 1 325 979 A1 7/2003
EP 1382373 A1 1/2004
JP 2004089543 A * 3/2004
WO WO-0188266 A1 * 11/2001 ..... B65D 85/808
WO WO-0192382 A1 * 12/2001 ..... A61L 15/28
WO 2012/135204 A1 10/2012
WO 2014/015921 A1 1/2014
WO WO-2017080910 A1 * 5/2017 ..... B65B 9/12
WO WO-2017110365 A1 * 6/2017 ..... B01D 39/16

OTHER PUBLICATIONS

Shimada, WO2017110365 A1, English machine translation (Year: 2017).*
Haraguchi, JP2004089543 A, English machine translation (Year: 2004).*
Rubber Rolls, Rubber Roller Manufacturers & Urethane Roller Manufacturers, 2016 (Year: 2016).*
Analytics, Overview of Wood Pulp, pp. 6-7, 2017 (Year: 2017).*
Shcherbak N.B., "Use of bleached softwood pulp in the composition of filter paper," Lomonosov Northern (Artic) Federal University, Oct. 22, 2018, 7 pages (in Russian).
Russian Patent Office, Office Action and Search Report, Application No. 2020135521, dated Dec. 3, 2021, 20 pages (with English translation).

(Continued)

*Primary Examiner* — Hayden Brewster
(74) *Attorney, Agent, or Firm* — BURNS & LEVINSON LLP

(57) ABSTRACT

Described herein is a filter paper for the production of an aqueous extract, comprising softwood pulp, which has the following properties: a basis weight of more than 9.0 g/m$^2$ and less than 13.5 g/m$^2$, a density of more than 280 kg/m$^3$ and less than 350 kg/m$^3$, a roughness of more than 700 ml/min and less than 1300 ml/min, a bending resistance in the machine direction of more than 50 mN and less than 75 mN, and an air permeability of more than 17000 cm/(min·kPa) and less than 26000 cm/(min·kPa), wherein the filter paper is either free from abacá fibers and sisal fibers or, if abacá fibers and/or sisal fibers are present, taken together they make up less than 20% of the paper mass.

37 Claims, No Drawings

(56) References Cited

OTHER PUBLICATIONS

International Searching Authority/European Patent Office, International Search Report and Written Opinion of the International Searching Authority, Application No. PCT/EP2019/055290, dated Jun. 25, 2019, with English translation of the International Search Report, 18 pages.

* cited by examiner

FILTER PAPER

CROSS-REFERENCE TO RELATED APPLICATIONS

This application is the national phase entry of International Patent Application No. PCT/EP2019/055290 filed on Mar. 4, 2019, and claims the benefit of German Patent Application No. 10 2018 107 944.3 filed Apr. 4, 2018, the disclosures of which are incorporated herein by reference in their entirety.

FIELD OF INVENTION

The invention relates to a filter paper for producing aqueous extracts, in particular for producing tea, coffee or other infused beverages, and a bag manufactured from this filter paper, in particular tea bags. The filter paper according to the invention is characterized by a small proportion or the complete absence of the commonly used abacá fibers or sisal fibers, as well as by a property profile deviating from the prior art. In spite of this, the filter paper according to the invention offers at least the same performance in use as filter papers known in the prior art.

BACKGROUND AND PRIOR ART

For producing aqueous extracts, in particular tea, coffee or other infused beverages, it is common to fill the material to be extracted, for example ground tealeaves, in defined portions into bags of a special filter paper. The bag is sealed and submerged in, typically hot, water for a defined time for producing the infused beverage and then removed again from the water. Processes are also known in which the bag is not sealed and is just suspended in the hot water instead of being submerged. The essential advantages when using these bags consist in the ease of handling, in the preportioning of the material to be extracted and in the simple removal of the material to be extracted from the water.

Despite this seemingly simple application there are, however, comparatively high demands placed on the filter paper. The filter paper should not disintegrate in water, so that the material to be extracted remains in the bag. It should have a high porosity, so that the water can easily flow around the material to be extracted by natural or forced convection and that the production of the extract does not take much time. Furthermore, the pores in the filter paper should not be too large so that small particles of the material to be extracted do not fall through the filter paper and remain in the extract. This property is determined by measurement of the so-called sand dusting.

Additionally, the filter paper itself should not release undesirable substances, in particular no undesirable flavoring substances or aromas, into the water. Finally, the filter paper should have mechanical properties that allow for industrial production of the bags at high speeds. This includes, for example, mechanical strength, elongation, roughness or heat sealability.

In the prior art it is common to produce filter papers for these applications from fibers that are sourced from the abacá plant (*Musa textilis*), a banana plant. These fibers are also called Manila hemp, banana hemp or *Musa* hemp, but they do not have any botanical relationship to the hemp plant (*cannabis*). According to the prior art, only these fibers enable a filter paper with high and uniform porosity, low basis weight and high strength to be produced. An alternative to these are fibers from the sisal plant (*Agave sisalana*), an *Agave* species, which in an equally misleading manner is also called sisal hemp.

For both kinds of fiber, but in particular for abacá fibers, it holds that because of the low demand and the special application, only few suppliers exist and the quality of the fibers varies substantially. This makes the production of filter papers comparatively difficult and expensive. However, in the past, attempts to produce filter papers without the use of abacá fibers or sisal fibers were not commercially successful, because in most cases, the technical properties of a filter paper that contained such fibers could not be achieved.

The proportion of abacá fibers or sisal fibers in the filter paper according to the prior art is generally more than 25% of the paper mass.

Aside from abacá fibers or sisal fibers, such filter papers also often contain synthetic fibers, in particular thermoplastic fibers, which provide heat sealability to the filter paper, so that sealed bags can be manufactured from the filter paper comparatively easily by sealing the filter paper to itself and no further materials are needed for sealing the bag.

The filter papers often also contain substances to increase the wet strength, so that they have sufficient mechanical strength during the production of the aqueous extract.

To produce bags from filter papers, techniques are used for joining two filter paper layers to each other. These techniques comprise sealing at elevated temperature, as it becomes possible by the use of thermoplastic fibers, or knurling, wherein the joint is achieved by high pressure and the knurling pattern. Combinations of these processes can also be used.

Thus, there is a need to reduce the proportion of abacá fibers or sisal fibers in filter paper as far as possible and to replace them with other, cheaper, more easily available fibers of more stable quality, without causing the suitability of this filter paper for producing aqueous extracts to suffer therefrom.

SUMMARY OF THE INVENTION

It is the object to provide a filter paper that can be used for producing aqueous extracts, in particular infused beverages such as tea or coffee, and which contains significantly fewer or no abacá fibers or sisal fibers. In this regard, the filter paper should offer the same performance for producing the aqueous extract as conventional filter papers.

A filter paper, a process for its manufacture, and a bag manufactured from the filter paper according to embodiments of the present invention are described below and recited in the claims.

The inventors have surprisingly found that this object can be achieved by a filter paper which comprises softwood pulp and has the following properties:

- a basis weight of more than 9.0 g/m$^2$ and less than 13.5 g/m$^2$,
- a density of more than 280 kg/m$^2$ and less than 350 kg/m$^2$,
- a roughness of more than 700 ml/min and less than 1300 ml/min,
- a bending resistance in the machine direction of more than 50 mN and less than 75 mN,
- an air permeability of more than 17000 cm/(min·kPa) and less than 26000 cm/(min·kPa), wherein the filter paper is either free from abacá fibers and sisal fibers, or if abacá fibers and/or sisal fibers are present, these taken together make up less than 20% of the paper mass.

The achievement of this object is surprising because the property profile of the filter paper according to the invention differs from filter papers known in the prior art in several respects. Apparently, the previously attempted approach, namely to achieve the same paper properties as in filter papers with such fibers without the use of abacá fibers and sisal fibers, was not successful. It was apparently erroneously assumed that the desired performance for producing an aqueous extract can only be achieved by these paper properties.

In contrast, the inventors have developed a filter paper, the properties of which differ from filter papers known in the prior art, but which in any case is not worse than the filter papers known in the prior art with respect to its performance for producing aqueous extracts. In particular, the inventors have found that the result can be achieved with a roughness, a bending resistance and an air permeability, which are each lower than that of filter papers known in the prior art. This combination of properties can be achieved by a special mechanical treatment, as is described further below.

The filter paper according to the invention comprises softwood pulp. The softwood pulp can be sourced from coniferous trees like spruce, pine or fir. It provides the filter paper with a high strength and air permeability, but does not entirely reach the same values as abacá fibers or sisal fibers thereby.

The proportion of softwood pulp in the filter paper is preferably at least 70%, particularly preferably at least 80% and highly particularly preferably at least 90%, respectively with respect to the mass of the filter paper. In a particularly preferable embodiment, the entire pulp in the filter paper according to the invention is formed by softwood pulp.

Alternatively, the softwood pulp can be replaced in part or totally by pulp from annual plants such as hemp, flax, kenaf or jute, with the exception of abacá or sisal. Pulp from annual plants, however, is not preferred because they are comparatively expensive, de-water badly during paper production and, similarly to abacá fibers and sisal fibers, suffer from quality variations.

The proportion of abacá fibers and sisal fibers taken together is less than 20%, preferably less than 10% and particularly preferably less than 5% of the mass of the filter paper. In a particularly preferred embodiment, the filter paper according to the invention is essentially, i.e. except for process-related impurities, free from abacá fibers and sisal fibers.

The filter paper according to the invention can contain hardwood pulp. The hardwood pulp can be sourced from deciduous trees like birch, beech or eucalyptus. Hardwood pulp increases the volume of the filter paper and reduces sand dusting, but also reduces the strength, for which reason the proportion in the filter paper according to the invention should be comparatively low. Preferably, the proportion of hardwood pulp in the filter paper according to the invention is at most 20%, particularly preferably at most 10% and preferably at least 2%, particularly preferably at least 5% of the paper mass.

The filter paper according to the invention can contain thermoplastic fibers. These fibers can comprise a thermoplastic material selected from the group consisting of polyethylene, polypropylene, polyester, such as polyethylene terephthalate, polyamide, polymethacrylate, polyacrylate, polyvinyl acetate, polyvinyl alcohol and polylactic acids, or blends thereof. In addition, bi-component fibers can preferably be used. The thermoplastic fibers provide heat sealability to the filter paper or improve the filter paper with respect to other properties, such as its porous structure or absorptivity. Preferably, the proportion of thermoplastic fibers in the filter paper according to the invention is at least 5%, particularly preferably at least 10% and preferably at most 30%, particularly preferably at most 20%, respectively with respect to the mass of the filter paper.

The filter paper according to the invention can also contain fibers from regenerated cellulose, preferably viscose fibers or Tencel® fibers, in order to influence the porous structure and other properties of the filter paper. The proportion of fibers from regenerated cellulose is preferably at most 15% and particularly preferably at most 10% of the mass of the filter paper.

In many papers, filler materials are used in order to increase the opacity or the brightness of the paper or to replace pulp with cheaper materials. Filler materials in the filter paper according to the invention can be selected from the group consisting of calcium carbonate, magnesium carbonate, magnesium hydroxide, aluminum hydroxide, magnesium silicates, aluminum silicates, kaolin and talcum or mixtures thereof. Because the filler materials reduce the strength of the filter paper, however, they are not desired in the filter paper according to the invention. Thus, preferably, the proportion of filler material in the filter paper according to the invention is less than 10% of the paper mass, particularly preferably less than 5% of the paper mass and highly particularly preferably, the filter paper according to the invention does not contain filler materials.

The skilled person can select further components of the filter paper according to the invention, such as wet strength additives or additives to increase the strength, such as starch, guar or carboxy methyl cellulose, according to his experience. In addition, the skilled person, according to his experience, can use process aids in the filter paper according to the invention, such as retention aids, for example.

The filter paper according to the invention has a basis weight of at least 9.0 g/m$^2$, preferably at least 10.0 g/m$^2$, particularly preferably at least 11.0 g/m$^2$ and at most 13.5 g/m$^2$, preferably at most 13.2 g/m$^2$, particularly preferably at most 13.0 g/m$^2$. The higher the basis weight of the filter paper, the higher is its strength, but also the material usage. The basis weight can be measured, for example, in accordance with ISO 536:2012.

Apart from the air permeability, the density of the filter paper is an essential factor which influences the speed with which an aqueous extract can be produced by using this filter paper. Generally, prior art filter papers have a density that is as low as possible of less than 280 kg/m$^3$. By means of a special mechanical treatment, however, the filter paper according to the invention has a higher density of at least 280 kg/m$^3$, preferably at least 290 kg/m$^3$ and particularly preferably at least 300 kg/m$^3$ and at most 350 kg/m$^3$, preferably at most 340 kg/m$^3$ and particularly preferably at most 330 kg/m$^3$. Experiments by the inventors show that these higher densities do not cause disadvantages in producing the aqueous extract.

Basis weight, density and thickness are closely linked parameters and the filter paper according to the invention preferably has a thickness of at least 38 μm, particularly preferably at least 40 μm, highly particularly preferably at least 41 μm and preferably at most 48 μm, particularly preferably at most 46 μm, highly particularly preferably at most 45 μm. Through this special mechanical treatment the thickness of the filter paper according to the invention is lower than that of conventional filter papers. The small thickness can contribute to a faster transport of water through the filter paper and thereby increase the speed at which an aqueous extract can be produced. Furthermore, a small thickness allows for more filter paper, with respect to the area, being present on a reel of filter paper for a given external diameter. When processing the filter paper, due to constructional circumstances on the manufacturing machines, the maximum external diameter of the filter paper reel is limited, so that per reel change, for example, more bags can be produced from the filter paper according to the invention because the number of bags that can be produced depends only on the area of the filter paper. Thus, the number of reel changes is reduced and the productivity can be increased.

Thickness and density can be measured, for example, on a single paper layer in accordance with ISO 534:2011.

In addition, the roughness of the filter paper according to the invention is of technical importance to processing the filter paper; in particular, a low roughness reduces the release of dust during processing. A low roughness, however, is also perceived by the consumer as a sign of quality. The filter paper according to the invention has a roughness of at least 700 ml/min, preferably at least 800 ml/min, particularly preferably at least 850 ml/min and at most 1300 ml/min, preferably at most 1200 ml/min and particularly preferably at most 1100 ml/min. The roughness can be determined, for example, in accordance with ISO 8791-2: 2013.

When using the filter paper according to the invention, the air permeability is of great importance to the production of an aqueous extract. A high permeability causes the water to flow comparatively more easily through the filter paper by natural or forced convection during production of the extract, to displace the air, and thus the extract can be produced in a short time. The filter paper according to the invention has an air permeability of at least 17000 cm/(min·kPa), preferably at least 18000 cm/(min·kPa), particularly preferably at least 19000 cm/(min·kPa) and at most 26000 cm/(min·kPa), preferably at most 25000 cm/(min·kPa), particularly preferably at most 24000 cm/(min·kPa). In this regard, the air permeability of the filter paper according to the invention is lower than that of conventional filter papers. Experiments show, however, that this is not a disadvantage. The measurement of the air permeability can be carried out in accordance with ISO 2965:2009.

The filter paper according to the invention can be characterized by a number of mechanical parameters such as bending resistance, elongation at break, tensile strength and tensile energy absorption. To measure these properties, test strips are cut from the filter paper, wherein the results depend on the direction in which the test strips were taken. Thus, for these parameters, a distinction is made between the machine direction, i.e. that direction in which the filter paper runs through the paper machine during its manufacture, and the cross direction, i.e. the direction in the filter paper plane orthogonal to the machine direction.

The bending resistance of the filter paper is of importance to the manufacture of bags from the filter paper and generally for the processing of the filter paper on machines. It should not be too high, so that the filter paper does not develop restoring forces during manufacture of the bags which are too high. The bending resistance of the filter paper according to the invention in the machine direction is at least 50 mN, preferably at least 55 mN, particularly preferably at least 58 mN and at most 75 mN, preferably at most 73 mN, particularly preferably at most 72 mN. In this regard, the bending resistance of the filter paper according to the invention in the machine direction is lower than that of filter papers that are known in the prior art, which often have a bending resistance in the machine direction of more than 80 mN. Thus, additional advantages arise during automatic processing of the filter paper. This low bending resistance is achieved by the low content of abacá fibers and sisal fibers in the filter paper according to the invention.

In the cross direction, the bending resistance of the filter paper according to the invention should be rather low. The bending resistance in the cross direction should preferably be at least 15 mN, particularly preferably at least 18 mN, highly particularly preferably at least 20 mN and at most 28 mN, particularly preferably at most 26 mN, highly particularly preferably at most 25 mN. The bending resistance of the filter paper according to the invention in the cross direction is thus also lower than the bending resistance of conventional filter papers in the cross direction, which is typically at least about 30 mN.

The bending resistance of a filter paper in the machine direction as well as in the cross direction can be measured in accordance with ISO 2493-1:2010, wherein the force to achieve a defined deformation is measured and given as the bending resistance.

The elongation at break of the filter paper is relevant to the automatic processing of the filter paper. Generally, a high elongation at break is of advantage, because then the filter paper can compensate for small speed differences in the manufacturing machine; but it should not be too high, because then it is difficult to cut the filter paper into pieces of a defined size, even under low loads. The elongation at break of the filter paper according to the invention in the machine direction is preferably at least 1.0%, preferably at least 1.2% and preferably at most 2.0%, particularly preferably at most 1.8%. The elongation at break of the filter paper according to the invention in the cross direction is preferably at least 1.8%, particularly preferably at least 2.4% and preferably at most 3.8%, particularly preferably at most 3.4%. The fact that the bending resistances in the machine direction and in the cross direction are relatively similar is a consequence of the special mechanical treatment wherein the paper structure is compressed. It thus represents an additional advantage of the filter paper according to the invention.

The tensile strength of the filter paper should be sufficiently high, primarily in the machine direction, so that the filter paper does not tear during its manufacture and processing. The tensile strength of the filter paper according to the invention in the machine direction is preferably at least 11.5 N/15 mm, particularly preferably at least 12.0 N/15 mm and preferably at most 15.0 N/15 mm, particularly preferably at most 14.0 N/15 mm.

In the cross direction, the tensile strength of the filter paper according to the invention is preferably at least 2.5 N/15 mm, particularly preferably at least 3.0 N/15 mm and preferably at most 5.0 N/15 mm and particularly preferably at most 4.5 N/15 mm. The elongation at break and the tensile strength in the machine direction and in the cross direction respectively, can be measured in accordance with ISO 1924-2:2008.

In addition, the tensile energy absorption is of importance to processing the filter paper according to the invention; this can also be determined in accordance with ISO 1924-2: 2008. The tensile energy absorption results, for example, from the stress-strain-curve for the filter paper at a constant rate of elongation. A high tensile energy absorption facilitates the automatic processing of the filter paper, because the filter paper can absorb the loads more easily during processing without tearing or permanent deformation. The filter paper according to the invention has a tensile energy absorption of preferably at least 6.0 J/m$^2$, particularly preferably at least 7.0 J/m$^2$ and preferably at most 11.0 J/m$^2$, particularly preferably at most 10.0 J/m$^2$.

The manufacture of the filter paper can mainly follow the methods of conventional papermaking. In a first step, the softwood pulp is suspended in water and refined in a refiner. During this refining step, the fibrils in the pulp fibers are exposed and the surface of the fibers is increased, whereby the strength of the filter paper manufactured therefrom is increased but at the same time its air permeability is reduced. Furthermore, the pulp fibers are shortened by more intense refining, which reduces the strength of the filter paper. The skilled person is able to determine a suitable degree of refining as a compromise between strength and air permeability by experience or by some experiments.

If present, hardwood pulp, synthetic fibers or other fiber material will also be suspended in water and can be refined, wherein hardwood pulp and synthetic fibers are preferably not refined. The suspensions of softwood pulp and, as the case may be, hardwood pulp, other fibers, optional filler materials, additives and processing aids, can be mixed and reach the head box of the paper machine. Preferably, the paper machine is an inclined-wire machine, wherein particularly preferably, the wire is inclined between 15° and 25° relative to the horizontal. The inclined-wire machine offers the advantage that suspensions with a very low solid content of about 0.02% can be processed and more porous papers can be produced thereby than with Fourdrinier machines.

From the headbox, the suspension of fibers, water and other components flows onto the running wire of the paper machine and it can be de-watered, in part by vacuum, through the wire. Thus, the filter paper is formed on the wire. The filter paper then preferably runs through a press section in which it is de-watered by mechanical pressure, and preferably again, through a drying section, preferably with humidification, in which it is dried at elevated temperature, for example by hot air, infra-red radiation or contact with heated cylinders. A size press or film press can be integrated into the drying section. At the end of the paper machine, the filter paper can be wound up, then cut into reels of defined width and length and then packed.

A particular feature, which differs from the prior art, in the manufacturing process of the filter paper according to the invention consists in that it is compressed with sufficient pressure so that the aforementioned properties are provided. This can be achieved during its production on the paper machine in the press section, for example, by running the filter paper through two rolls, preferably two steel rolls, which exert mechanical pressure on the filter paper. Particularly preferably, the steel rolls are coated with a plastic coating. Preferably, the line load therein is at least 30 kN/m and at most 100 kN/m. Due to this mechanical compression of the filter paper, the thickness, roughness and air permeability are reduced and the density is increased, which creates the very specific property profile for the filter paper according to the invention. In addition, this process has an influence on the mechanical parameters such as bending resistance, strength, elongation at break and tensile energy absorption. In accordance with the prior art, mechanical compression of a filter paper for the production of aqueous extracts is considered undesirable, because it was assumed that this would reduce the air permeability by too much and the density would be increased too much, and thus the aqueous extract could no longer be produced in a short time. The inventors have surprisingly found that losses due to higher density and lower air permeability are indeed present, but are not so large that they have a considerable effect on the production of aqueous extracts when using the filter paper according to the invention. But it is precisely this mechanical compression of the filter paper that allows the use of abacá fibers and sisal fibers to be partially or entirely dispensed with, because the structure of the filter paper is indeed slightly compressed thereby, but also its strength is substantially increased. Thus, high air permeability can be combined with sufficient strength even when solely softwood pulp is used.

In the equilibrium state, conventional filter papers have a moisture content of about 7% of the paper mass under the conditions specified in ISO 187:1990 of 50% relative humidity and 23° C. The moisture content of the filter paper can be measured by determination of the paper mass before and after drying a defined amount of filter paper in accordance with ISO 287:2009. For the conventional manufacture of bags from filter paper, it has proved to be beneficial to adjust the moisture content of the filter paper to a value of 7% to 8%. At this moisture content, the filter paper can be processed well, because the fibers are sufficiently flexible. In particular, knurling in order to join two layers of filter paper is facilitated. In accordance with the prior art, the moisture content should not substantially exceed 8%, because then the fibers would be too flexible and the desired strength of the joint could not be obtained during knurling.

Generally, the moisture content can be adjusted by humidification during manufacture of the tea bags, but this means an additional outlay regarding machines.

The inventors, however, have found that for filter papers, an even higher moisture content of preferably at least 9%, particularly preferably at least 10%, highly particularly preferably at least 11% and preferably at most 20%, particularly preferably at most 18%, highly particularly preferably at most 15%, offers further advantages. Contrary to expectations, this high moisture content increases the strength of the joint between the paper layers produced by knurling.

Because this moisture content does not correspond to the equilibrium state which is reached during storage under common environmental conditions, and because humidification during the manufacture of bags means an additional outlay, a further embodiment of the invention consists in packing the filter paper essentially impermeably to water vapor with a moisture content that is greater than the equilibrium state and, for example, in providing it in form of a reel, packed essentially impermeably to water vapor.

The invention thus also comprises a filter paper packed essentially impermeably to water vapor, wherein the filter paper has a moisture content of at least 9%, preferably at least 10%, particularly preferably at least 11% and at most 20%, preferably at most 18% and particularly preferably at most 15%. The moisture content can be measured in accordance with ISO 287:2009.

Preferably, the filter paper in the packed reel comprises softwood pulp, wherein the filter paper is either free from abacá fibers and sisal fibers, or if abacá fibers and/or sisal fibers are present, taken together, they make up less than 20%, particularly preferably less than 10% and highly particularly preferably less than 5% of the mass of the filter paper.

Particularly preferably, the filter paper in the reel packed essentially impermeably to water vapor is a filter paper according to one of the aforementioned embodiments.

Such a reel can be produced by drying the filter paper to the desired moisture content at the end of the paper machine, winding up the filter paper on a reel and packing the reel in a material essentially impermeable to water vapor.

In this regard, the material essentially impermeable water vapor is preferably a plastic film, particularly preferably a film produced from polyethylene or polypropylene. Also preferably, a suitable packaging paper can be used as material essentially impermeable to water vapor. In this regard, "essentially impermeable to water vapor" means that the moisture content of the filter paper in the packed reel, measured in accordance with ISO 287:2009, is not less than 8% of the paper mass after the packed reel has been stored for at least 3 days under the conditions of 50% relative humidity and 23° C. specified in ISO 187:1990.

Alternatively, a packaging material is considered "essentially impermeable to water vapor" for the purposes of this invention if its water vapor transmission rate (WVTR) measured in accordance with ISO 2528:2017 at 37° C. and 90% relative humidity is less than 600 g/($m^2$·d), preferably less than 400 g/($m^2$·d) and particularly preferably less than 350 g/($m^2$·d).

The packed reel according to the invention and the filter paper according to the invention can be processed using machines that are known in the prior art, wherein preferably, no further humidification during processing of the filter paper is needed. In particular, sealed bags can be formed from the filter paper, in which the material to be extracted is filled. Preferably, these bags are tea bags.

The invention thus also comprises bags filled with extractable material, which have been manufactured from the filter paper according to the invention, wherein the extractable material is preferably tea.

DESCRIPTION OF THE PREFERRED EMBODIMENTS

The invention shall now be described more precisely using a few embodiments according to the invention and be compared to filter papers not according to the invention.

Three filter papers according to the invention, designated as A, B and C, were manufactured from 100% softwood pulp on an inclined-wire machine. The softwood pulp was refined to a degree of refining of 20° SR, measured in accordance with ISO 5267-1:1999, and was applied as a suspension with a solid content of 0.016% onto the running web of an inclined-wire machine, inclined by 20 relative to the horizontal. Then the filter paper ran through a press section, wherein it was compressed with a line load of 65 kN/m between two steel rolls coated with plastic to compact the paper structure. This reduced both the thickness and air permeability. Next, the filter paper ran through the drying section, in which it was dried to a moisture content of 9.7%. Finally, the filter paper was wound up at the end of the paper machine and was packed essentially impermeably to water vapor in a polyethylene film. In this regard, the settings of the paper machine were slightly varied so that slightly different properties of the filter papers A, B and C resulted.

A fourth filter paper according to the invention, labelled D, was produced from 82% softwood pulp and 18% abacá fibers. The softwood pulp and the abacá fibers were refined to a degree of refining of 23° SR, measured in accordance with ISO 5267-1:1999, and they were applied as a suspension with a solid content of 0.016% onto the running web of an inclined-wire machine, inclined by 20° relative to the horizontal. Then the filter paper ran through a press section, wherein it was compressed with a line load of 60 kN/m between two steel rolls coated with plastic to compact the paper structure. This reduced both the thickness and air permeability. Next, the filter paper ran through the drying section, in which it was dried to a moisture content of 10.3%. Finally, the filter paper was wound up at the end of the paper machine and was packed essentially impermeably to water vapor in a polyethylene film.

The basis weight, density, thickness, roughness, bending resistance in the machine direction and air permeability were determined for all of the filter papers according to the invention.

Furthermore three typical, commercially available filter papers not according to the invention, labelled X, Y, Z, were analysed microscopically with respect to their content of abacá fibers and sisal fibers and in addition the basis weight, density, thickness, roughness, bending resistance in the machine direction and air permeability were determined.

The results are summarized in Table 1 and show the content of abacá and sisal fibers (AS), the basis weight (BW), the density (ρ), the thickness (d), the roughness (R), the bending resistance in the machine direction (BR-MD) and the air permeability (AP).

TABLE 1

| Paper | AS % | BW g/$m^2$ | ρ kg/$m^3$ | d µm | R ml/min | BR-MD mN | AP cm/(min · kPa) |
|---|---|---|---|---|---|---|---|
| A | 0 | 13.0 | 284 | 42.3 | 1141 | 71 | 20685 |
| B | 0 | 12.7 | 306 | 42.1 | 1050 | 67 | 23040 |
| C | 0 | 12.8 | 301 | 40.4 | 872 | 60 | 21549 |
| D | 18 | 12.9 | 316 | 45.4 | 1088 | 53 | 24332 |
| X | 44 | 12.7 | 245 | 51.6 | 1549 | 99 | 33127 |
| Y | 49 | 12.5 | 257 | 48.6 | 1283 | 70 | 25854 |
| Z | 57 | 12.7 | 255 | 49.8 | 1509 | 77 | 36761 |

The results show that the filter papers according to the invention have lower values with respect to thickness and roughness and higher values with respect to density than any filter paper not according to the invention. This difference is caused by the compression of the filter paper, which reduces the roughness and the thickness and, at the same basis weight, increases the density. An undesirable side-effect is that the air permeability is also reduced thereby, and it is lower for all filter papers according to the invention than for the filter papers not according to the invention. As further experiments show, this slightly lower air permeability has practically no effect on the production of an aqueous extract using the filter papers according to the invention.

With one exception: filter paper A compared to filter paper Y, the bending resistance of the filter papers according to the invention is lower than that of the filter papers not according to the invention. This difference is caused on the one hand by the lower content of abacá fibers and sisal fibers and on the other hand by the reduced thickness due to the mechanical compression.

The essential mechanical properties of the filter papers according to the invention were determined, which are summarized in Table 2. Table 2 contains the bending resistance in the cross direction (BR-CD), the tensile strength in the machine direction (F-MD) and in the cross direction (F-CD), the elongation at break in the machine direction (E-MD) and in the cross direction (E-CD) and the tensile energy absorption in the machine direction (TEA-MD).

TABLE 2

| Paper | | A | B | C | D |
|---|---|---|---|---|---|
| BR-CD | mN | 22 | 22 | 20 | 23 |
| F-MD | N/15 mm | 12.8 | 14.0 | 14.4 | 15.0 |
| F-CD | N/15 mm | 3.5 | 3.1 | 2.9 | 4.4 |
| E-MD | % | 1.2 | 1.3 | 1.3 | 1.6 |

TABLE 2-continued

| Paper | | A | B | C | D |
|---|---|---|---|---|---|
| E-CD | % | 2.6 | 2.7 | 2.2 | 3.5 |
| TEA-MD | $J/m^2$ | 7.1 | 7.9 | 8.3 | 10.1 |

The strength of a joint between two layers of the filter papers produced by knurling was tested, wherein values between 1.5 N and 2.0 N resulted, while conventional filter papers achieved between 1.0 N and 1.7 N under the same test conditions. In this regard, it was shown that the high moisture content of the filter papers can have a positive effect on the strength of the knurled joints.

Tea bags according to the invention filled with tea were produced without any further problems from the four filter papers according to the invention A, B, C and D on various conventional tea bag machines such as IMA C24, IMA C27 and Teepack Perfecta. The tea bags manufactured from the four filter papers according to the invention were compared to three commercially available tea bags with the same geometry and filling, which were manufactured on the same machines. Therefore, containers were prepared with 0.5 liters of tap water with a temperature of 90° C. and each tea bag was submerged in a separate container. The tea was judged optically with respect to the speed of the discoloration of the tap water in the container after a few seconds, because this speed of discoloration is also the criterion that a consumer will observe during the production of tea. With regard to the tea bags according to the invention and not according to the invention, no perceptible difference was found, which was confirmed by UV-VIS measurements. Sand dusting of the tea bags was assessed. To this end, sand with a particle size of 106 μm to 150 μm was filled into the tea bags, and then the tea bags were shaken in an apparatus and the amount of sand that fell through the pores of the filter paper was weighed. Also in this respect, no significant differences between the filter papers according to the invention and not according to the invention were found.

Thus it is shown that tea bags can be produced from the filter papers according to the invention with partial or complete absence of abacá fibers and sisal fibers, which do not differ in their performance compared to conventional tea bags, even though this was to be expected because of the technical properties of the filter papers. Furthermore, about 10% more tea bags could be manufactured from a reel of the same outer diameter compared to conventional filter papers due to the 10% lower density, which allows for an additional increase in productivity.

The invention claimed is:

1. A filter paper for the production of an aqueous extract, comprising softwood pulp, which has the following properties:

a basis weight of more than 9.0 $g/m^2$ and less than 13.5 $g/m^2$, a density of more than 280 $kg/m^3$ and less than 350 $kg/m^3$, a roughness of more than 700 ml/min and less than 1300 ml/min, a bending resistance in the machine direction of more than 50 mN and less than 75 mN, and an air permeability of more than 17000 cm/(min·kPa) and less than 26000 cm/(min·kPa), wherein the filter paper is either free from abacá fibers and sisal fibers or, if abacá fibers and/or sisal fibers are present, taken together they make up less than 20% of the paper mass, and wherein the content of softwood pulp in the filter paper is at least 70% with respect to the mass of the filter paper.

2. The filter paper according to claim 1, wherein the softwood pulp is sourced from spruce, pine or fir.

3. The filter paper according to claim 1, wherein a content of abacá fibers and sisal fibers taken together is less than 10% of the mass of the filter paper.

4. The filter paper according to claim 1, which further contains hardwood pulp, whereby the hardwood pulp is sourced from birch, beech or eucalyptus, and wherein the content of hardwood pulp is at most 20% of the paper mass.

5. The filter paper according to claim 1, which is free of hardwood pulp.

6. The filter paper according to claim 1, which further contains thermoplastic fibers.

7. The filter paper according to claim 6, wherein the thermoplastic fiber material is selected from the group consisting of polyethylene, polypropylene, polyester polyamide, polymethacrylate, polyacrylate, polyvinyl acetate, polyvinyl alcohol and polylactic acids or mixtures thereof.

8. The filter paper according to claim 6, wherein the content of thermoplastic fibers is at least 5% and at most 30%, respectively with respect to the mass of the filter paper.

9. The filter paper according to claim 1, which contains one or more filler materials which are selected from the group consisting of calcium carbonate, magnesium carbonate, magnesium hydroxide, aluminum hydroxide, magnesium silicates, aluminum silicates, kaolin and talcum or mixtures thereof.

10. The filter paper according to claim 9, wherein the content of filler materials is less than 10% of the paper mass.

11. The filter paper according to claim 1, which is free from filler materials.

12. The filter paper according to claim 1, with a basis weight of at least 10.0 $g/m^2$ and a basis weight of at most 13.2 $g/m^2$.

13. The filter paper according to claim 1, with a density of at least 290 $kg/m^3$ and a density of at most 340 $kg/m^3$.

14. The filter paper according to claim 1, with a thickness of at least 38 μm and a thickness of at most 48 μm.

15. The filter paper according to claim 1, with a roughness in accordance with ISO 8791-2:2013 of at least 800 ml/min and of at most 1200 ml/min.

16. The filter paper according to claim 1, with an air permeability in accordance with ISO 2965:2009 of at least 18000 cm/(min·kPa) and at most 25000 cm/(min·kPa).

17. The filter paper according to claim 1, with a bending resistance in accordance with ISO 2493-1:2010 in the machine direction of at least 55 mN and at most 73 mN.

18. The filter paper according to claim 1, with a bending resistance in accordance with ISO 2493-1:2010 in the cross direction of at least 15 mN and at most 28 mN.

19. The filter paper according to claim 1, which has an elongation at break in the machine direction of at least 1.0% and at most 2.0% and which has an elongation at break in the cross direction of at least 1.8% and at most 3.8%.

20. The filter paper according to claim 1, which has a tensile strength in the machine direction of at least 11.5 N/15 mm and at most 15.0 N/15 mm and which has a tensile strength in the cross direction of at least 2.5 N/15 mm and at most 5.0 N/15 mm.

21. The filter paper according to claim 1, which has a tensile energy absorption in accordance with ISO 1924-2: 2008 in the machine direction of at least 6.0 $J/m^2$ and at most 11.0 $J/m^2$.

22. The filter paper according to claim 1, which is packed essentially impermeably to water vapor and has a moisture content of at least 9% and at most 20%.

23. A process for manufacturing a filter paper, which is either free from abacá fibers and sisal fibers, or if abacá fibers and/or sisal fibers are present, taken together, these make up less than 20% of the paper mass, wherein the process comprises the following steps:

suspending softwood pulp in water and refining at least the softwood pulp in a refiner, delivering a suspension, which contains at least the refined softwood pulp, onto the wire of a paper machine, de-watering the suspension through the wire of the paper machine to form a paper, and pressing the paper with a sufficient pressure to provide the paper with the following properties:

a basis weight of more than 9.0 $g/m^2$ and less than 13.5 $g/m^2$, a density of more than 280 $kg/m^3$ and less than 350 $kg/m^3$, a roughness of more than 700 ml/min and less than 1300 ml/min, a bending resistance in the machine direction of more than 50 mN and less than 75 mN, and an air permeability of more than 17000 cm/(min·kPa) and less than 26000 cm/(min·kPa).

24. The process according to claim 23, wherein the filter paper is a filter paper for the production of an aqueous extract, comprising softwood pulp, which has the following properties:

a basis weight of more than 9.0 $g/m^2$ and less than 13.5 $g/m^2$, a density of more than 280 $kg/m^3$ and less than 350 $kg/m^3$, a roughness of more than 700 ml/min and less than 1300 ml/min, a bending resistance in the machine direction of more than 50 mN and less than 75 mN, and an air permeability of more than 17000 cm/(min kPa) and less than 26000 cm/(min·kPa), wherein the filter paper is either free from abacá fibers and sisal fibers or, if abacá fibers and/or sisal fibers are present, taken together they make up less than 20% of the paper mass, and wherein the content of softwood pulp in the filter paper is at least 70% with respect to the mass of the filter paper.

25. The process according to claim 23, wherein the paper machine is an inclined-wire machine, wherein the wire is inclined between 15° and 25° relative to the horizontal.

26. The process according to claim 23, wherein, after the wire section, the filter paper runs through a press section, in which it is further de-watered, wherein the press section comprises two rolls which form a nip through which the paper runs and is exposed to a line load of 30 kN/m and at most 100 kN/m.

27. The process according to claim 23, wherein after pressing, the filter paper is dried by hot air, infra-red radiation or contact with heated cylinders.

28. The process according to claim 23, wherein the filter paper in a state with a moisture content of at least 9% and at most 20% is packed essentially impermeable to water vapor.

29. A bag formed from the filter paper according to claim 1, which contains a material to be extracted, wherein the material to be extracted is tea.

30. The filter paper according to claim 1, wherein the content of softwood pulp in the filter paper is at least 90% with respect to the mass of the filter paper.

31. The filter paper according to claim 1, wherein all of the pulp in the filter paper is formed by softwood pulp.

32. The filter paper according to claim 4, wherein the content of hard wood pulp is at least 2% of the paper mass.

33. The filter paper according to claim 6, wherein the thermoplastic fibers are made of polyethylene terephthalate.

34. The filter paper according to claim 12, with a basis weight of at least 11 $g/m^2$ and at most 13.0 $g/m^2$.

35. The filter paper according to claim 1, with a thickness of at least 41 μm and at most 45 μm.

36. The process according to claim 26, wherein the rolls are steel rolls coated with a plastic coating.

37. The process according to claim 27, wherein the drying step comprises humidification.

* * * * *